US011162054B2

(12) United States Patent
Backer et al.

(10) Patent No.: US 11,162,054 B2
(45) Date of Patent: Nov. 2, 2021

(54) AUTOMATIC DISHWASHING COMPOSITION WITH DISPERSANT POLYMER

(71) Applicants: Dow Global Technologies LLC, Midland, MI (US); Rohm and Haas Company, Collegeville, PA (US)

(72) Inventors: Scott Backer, Phoenixville, PA (US); Randara Pulukkody, Landsdale, PA (US); Severine Ferrieux, Grasse (FR)

(73) Assignees: Dow Global Technologies LLC, Midland (ML); Rohm and Haas Company, Collegeville, PA (US)

( * ) Notice: Subject to any disclaimer, the term of this patent is extended or adjusted under 35 U.S.C. 154(b) by 0 days.

(21) Appl. No.: 17/045,667

(22) PCT Filed: Apr. 25, 2019

(86) PCT No.: PCT/US2019/029043
§ 371 (c)(1),
(2) Date: Oct. 6, 2020

(87) PCT Pub. No.: WO2019/217082
PCT Pub. Date: Nov. 14, 2019

(65) Prior Publication Data

US 2021/0179973 A1 Jun. 17, 2021

(30) Foreign Application Priority Data

May 9, 2018 (EP) ..... 18290055

(51) Int. Cl.
*C11D 3/08* (2006.01)
*C11D 3/10* (2006.01)
(Continued)

(52) U.S. Cl.
CPC ..... *C11D 3/3761* (2013.01); *C11D 1/72* (2013.01); *C11D 3/046* (2013.01); *C11D 3/08* (2013.01); *C11D 3/10* (2013.01); *C11D 3/2086* (2013.01); *C11D 3/361* (2013.01); *C11D 3/3757* (2013.01); *C11D 3/3765* (2013.01); *C11D 3/3788* (2013.01); *C11D 3/38609* (2013.01); *C11D 3/3917* (2013.01); *C11D 3/3942* (2013.01);
(Continued)

(58) Field of Classification Search
CPC ..... C11D 3/08; C11D 3/10; C11D 3/3757; C11D 3/3765; C11D 3/3788; C11D 3/3951; B08B 3/08
USPC ..... 510/220, 221, 229, 230, 370, 475, 477, 510/509, 511, 467; 134/25.2
See application file for complete search history.

(56) References Cited

U.S. PATENT DOCUMENTS 4,532,048 A 7/1985 Amjad et al.
5,191,048 A 3/1993 Swift et al.
(Continued)

FOREIGN PATENT DOCUMENTS

DE 4300772 7/1994
EP 0497611 8/1992
(Continued)

*Primary Examiner* — Gregory R Delcotto
(74) *Attorney, Agent, or Firm* — Thomas S. Deibert

(57) ABSTRACT

An automatic dishwashing composition is provided including a builder; a phosphonate; a nonionic surfactant; and a dispersant polymer, comprising: 10 to 65 wt % of structural units of formula I (I)

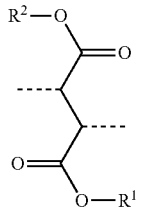

wherein each $R^1$ and $R^2$ is independently selected from a hydrogen and a $C_{1-3}$ alkyl group; 10 to 80 wt % of structural units of formula II (II)

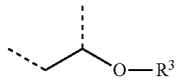

wherein each $R^3$ is independently selected from a hydrogen and a —C(O)$CH_3$ group; and 10 to 65 wt % of structural units of formula III (III)

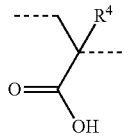

wherein each $R^4$ is independently selected from a hydrogen and a —$CH_3$ group; and wherein at least one of $R^1$ and $R^2$ is a $C_{1-3}$ alkyl group in at least 1 mol % of the structural units of formula I in the dispersant polymer; wherein the dispersant polymer has a lactone end group and wherein the dispersant polymer has a weight average molecular weight of 1,500 to 6,000 Daltons.

9 Claims, No Drawings

(51) Int. Cl.

| | |
|---|---|
| ***C11D 3/37*** | (2006.01) |
| ***C11D 3/395*** | (2006.01) |
| ***C11D 1/72*** | (2006.01) |
| ***C11D 3/04*** | (2006.01) |
| ***C11D 3/20*** | (2006.01) |
| ***C11D 3/36*** | (2006.01) |
| ***C11D 3/386*** | (2006.01) |
| ***C11D 3/39*** | (2006.01) |
| ***C11D 11/00*** | (2006.01) |

(52) U.S. Cl.
CPC ..... *C11D 3/3951* (2013.01); *C11D 11/0023* (2013.01)

(56) References Cited

U.S. PATENT DOCUMENTS

| | | | | |
|---|---|---|---|---|
| 5,431,846 | A | 7/1995 | Christopher et al. | |
| 11,015,147 | B2 * | 5/2021 | Wang | C11D 3/3761 |
| 2021/0198599 | A1 * | 7/2021 | Wang | C11D 1/66 |

FOREIGN PATENT DOCUMENTS

| | | |
|---|---|---|
| EP | 2366768 | 9/2011 |
| WO | 2017062222 | 4/2017 |

* cited by examiner

AUTOMATIC DISHWASHING COMPOSITION WITH DISPERSANT POLYMER

The present invention relates to a dispersant polymer for use in automatic dish washing formulations. In particular, the present invention relates to automatic dishwashing compositions incorporating a dispersant polymer having good spotting and/or filming performance while also having enhanced biodegradability.

Automatic dishwashing compositions are generally recognized as a class of detergent compositions distinct from those used for fabric washing or water treatment. Automatic dishwashing compositions are expected by users to produce a spotless and film-free appearance on washed articles after a complete cleaning cycle.

Phosphate-free automatic dishwashing compositions are increasingly desirable. Phosphate-free automatic dishwashing compositions typically rely on non-phosphate builders, such as salts of citrate, carbonate, silicate, disilicate, bicarbonate, aminocarboxylates and others to sequester calcium and magnesium from hard water, and upon drying, leave an insoluble visible deposit.

A family of polycarboxylate copolymers and their use as builders in detergent compositions and rinse aid compositions is disclosed by Christopher et al. in U.S. Pat. No. 5,431,846 for use in the final rinse step of a dish or warewashing machine. Christopher et al. disclose block copolymers comprising from 20 to 95 mole % of monomer units derived from itaconic acid or a homologue thereof and from 5 to 80 mole % of monomer units derived from vinyl alcohol or a lower vinyl ester are excellent binders of divalent or polyvalent metals and are useful as potentially biodegradable builders in detergent compositions as well as in machine dishwashing compositions and anti-scaling rinse compositions.

A family of terpolymers and their use, among other things, as dispersants is disclosed by Swift et al in U.S. Pat. No. 5,191,048. Swift et al teach a terpolymer comprising as polymerized units from about 15 to 55 mole percent of at least one first monomer selected from the group consisting of vinyl acetate, vinyl ethers and vinyl carbonates, from about 10 to 70 mole percent of at least one second monomer of an ethylenically unsaturated monocarboxylic acid, and from about 15 to 55 mole percent of at least one third monomer of an anhydride of a dicarboxylic acid and wherein said terpolymer is formed in a non-aqueous system such that less than about one more percent of the monomers are hydrolyzed during said polymerization.

Notwithstanding there remains a need for new dispersant polymers for use in automatic dish washing formulations. In particular, there remains a need for new dispersant polymers for use in automatic dish washing formulations, wherein the dispersant polymers provide suitable spotting and/or filming performance in combination with having enhanced biodegradability.

The present invention provides a dispersant polymer, comprising: (a) 10 to 65 wt % of structural units of formula I (I)

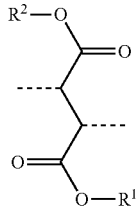

wherein each $R^1$ and $R^2$ is independently selected from a hydrogen and a $C_{1-3}$ alkyl group; (b) 10 to 80 wt % of structural units of formula II (II)

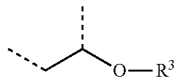

wherein each $R^3$ is independently selected from a hydrogen and a —C(O)$CH_3$ group; and (c) 10 to 65 wt % of structural units of formula III (III)

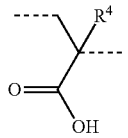

wherein each $R^4$ is independently selected from a hydrogen and a —$CH_3$ group; wherein at least one of $R^1$ and $R^2$ is a $C_{1-3}$ alkyl group in at least 1 mol % of the structural units of formula I in the dispersant polymer; wherein the dispersant polymer has a lactone end group and wherein the dispersant polymer has a weight average molecular weight of 1,500 to 6,000 Daltons.

The present invention provides an automatic dishwashing composition, comprising: a builder; a phosphonate; a nonionic surfactant; and a dispersant polymer, comprising: (a) 10 to 65 wt % of structural units of formula I (I)

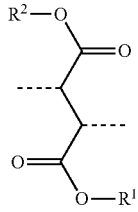

wherein each $R^1$ and $R^2$ is independently selected from a hydrogen and a $C_{1-3}$ alkyl group; (b) 10 to 80 wt % of structural units of formula II (II)

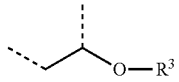

wherein each $R^3$ is independently selected from a hydrogen and a —C(O)$CH_3$ group; and (c) 10 to 65 wt % of structural units of formula III (III)

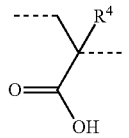

wherein each $R^4$ is independently selected from a hydrogen and a —$CH_3$ group; wherein at least one of $R^1$ and $R^2$ is a $C_{1-3}$ alkyl group in at least 1 mol % of the structural units of formula I in the dispersant polymer; wherein the dispersant polymer has a lactone end group and wherein the dispersant polymer has a weight average molecular weight of 1,500 to 6,000 Daltons.

The present invention provides a method of cleaning an article in an automatic dishwashing machine, comprising: providing at least one article; providing an automatic dishwashing composition according to the present invention; and, applying the automatic dishwashing composition to the at least one article.

DETAILED DESCRIPTION

The dispersant polymer of the present invention exhibits desirable biodegradability properties. When incorporated in automatic dishwashing compositions (particularly phosphate-free automatic dishwashing compositions), the dispersant polymer of the present invention as particularly described herein surprisingly give good antispotting performance and filming performance versus conventional dispersant polymers, but while also providing biodegradability that is desired to facilitate formulation of more sustainable automatic dishwashing compositions. In addition, the dispersant polymer of the present invention is also surprisingly hard water tolerant, unlike conventional maleic acid residue containing polymers that are susceptible to complexation with $Ca^{2+}$ ions present in hard water, leading to flocculation and precipitation.

Unless otherwise indicated, ratios, percentages, parts, and the like are by weight. Weight percentages (or wt %) in the composition are percentages of dry weight, i.e., excluding any water that may be present in the composition. Percentages of monomer units in the polymer are percentages of solids weight, i.e., excluding any water present in a polymer emulsion.

As used herein, unless otherwise indicated, the terms "weight average molecular weight" and "Mw" are used interchangeably to refer to the weight average molecular weight as measured in a conventional manner with gel permeation chromatography (GPC) and conventional standards, such as polystyrene standards. GPC techniques are discussed in detail in Modem Size Exclusion Chromatography, W. W. Yau, J. J. Kirkland, D. D. Bly; Wiley-lnterscience, 1979, and in A Guide to Materials Characterization and Chemical Analysis, J. P. Sibilia; VCH, 1988, p. 81-84. Weight average molecular weights are reported herein in units of Daltons.

The term "ethylenically unsaturated" as used herein and in the appended claims describes molecules having a carbon-carbon double bond, which renders it polymerizable. The term "multi-ethylenically unsaturated" as used herein and in the appended claims describes molecules having at least two carbon-carbon double bonds.

As used herein the term "(meth)acrylic" refers to either acrylic or methacrylic.

The terms "Ethyleneoxy" and "EO" as used herein and in the appended claims refer to a —$CH_2$—$CH_2$—O— group.

The term "phosphate-free" as used herein and in the appended claims means compositions containing ≤1 wt % (preferably, ≤0.5 wt %; more preferably, ≤0.2 wt %; still more preferably, ≤0.01 wt %; yet still more preferably, ≤0.001 wt %; most preferably, less than the detectable limit) of phosphate (measured as elemental phosphorus).

The term "structural units" as used herein and in the appended claims refers to the remnant of the indicated monomer; thus a structural unit of (meth)acrylic acid is illustrated:

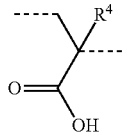

wherein the dotted lines represent the points of attachment to the polymer backbone and where $R^4$ is a hydrogen for structural units of acrylic acid and a —$CH_3$ for structural units of methacrylic acid.

Preferably, the dispersant polymer of the present invention, comprises: (a) 10 to 65 wt % (preferably, 20 to 60 wt %; more preferably, 20 to 50 wt %; still more preferably, 25 to 40 wt %; most preferably, 25 to 35 wt %)(preferably, ≥20 wt %; more preferably, ≥25 wt %; preferably, ≤60 wt %; more preferably, ≤50 wt %; still more preferably, ≤40 wt %; most preferably, ≤35 wt %) of structural units of formula I;

(I)

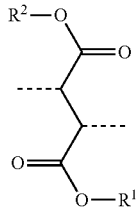

wherein each $R^1$ and $R^2$ is independently selected from a hydrogen and a $C_{1-3}$ alkyl group (preferably, a hydrogen and a $C_{2-3}$ alkyl group; more preferably, a hydrogen and a $C_3$ alkyl group)(preferably, wherein at least one of $R^1$ and $R^2$ is a $C_3$ alkyl group in at least 1 mol % of the structural units of formula I in the dispersant polymer); (b) 10 to 80 wt % (preferably, 15 to 75 wt %; more preferably, 20 to 60 wt %; most preferably, 30 to 50 wt %)(preferably, ≥20 wt %; more preferably, ≥25 wt %; still more preferably, ≥30 wt %; most preferably, ≥35 wt %; preferably, ≤70 wt %; more preferably, ≤60 wt %; most preferably, ≤50 wt %) of structural units of formula II (II)

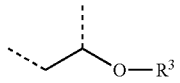

wherein each $R^3$ is independently selected from a hydrogen and a —C(O)$CH_3$ group; and (c) 10 to 65 wt % (preferably, 20 to 60 wt %; more preferably, 20 to 50 wt %; still more preferably, 25 to 40 wt %; most preferably, 25 to 35 wt %)(preferably, ≥20 wt %; more preferably, ≥25 wt %; preferably, ≤60 wt %; more preferably, ≤50 wt %; still more preferably, ≤40 wt %; most preferably, ≤35 wt %) of structural units of formula III (III)

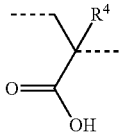

wherein each $R^4$ is independently selected from a hydrogen and a —$CH_3$ group; wherein at least one of $R^1$ and $R^2$ is a $C_{1-3}$ alkyl group in at least 1 mol % of the structural units of formula I in the dispersant polymer; wherein the dispersant polymer has a lactone end group and wherein the dispersant polymer has a weight average molecular weight of 1,500 to 6,000 Daltons (preferably, 1,500 to ≤5,000 Daltons; more preferably, 1,750 to 4,500 Daltons; most preferably, 2,250 to 4,250 Daltons).

Preferably, the automatic dishwashing composition of the present invention, comprises: a builder (preferably, 1 to 97 wt % (more preferably ≥1 wt %; still more preferably, ≥10 wt %; yet still more preferably, ≥25 wt %; most preferably, ≥50 wt %; preferably, ≤95 wt %; more preferably, ≤90 wt %; still more preferably, ≤85 wt %; most preferably, ≤80 wt %), based on the dry weight of the automatic dishwashing composition, of the builder)(preferably, wherein the builder is selected from the group consisting of carbonate, bicarbonate, citrate, silicate and mixtures thereof); a phosphonate (preferably, 0.1 to 15 wt % (more preferably, 0.5 to 10 wt %; still more preferably, 0.75 to 7.5 wt %; most preferably, 1 to 5 wt %), based on the dry weight of the automatic dishwashing composition, of the phosphonate)(preferably, wherein the phosphonate has a weight average molecular weight of ≤1,000 Daltons); a nonionic surfactant (preferably, 0.2 to 15 wt % (more preferably, 0.5 to 10 wt %; most preferably, 1.5 to 7.5 wt %), based on the dry weight of the automatic dishwashing composition, of the nonionic surfactant)(preferably, wherein the nonionic surfactant is a fatty alcohol alkoxylate); and a dispersant polymer (preferably, 0.5 to 15 wt % (more preferably, 0.5 to 10 wt %; still more preferably, 1 to 8 wt %; most preferably, 2 to 6 wt %), based on the dry weight of the automatic dishwashing composition, of the dispersant) comprising: (a) 10 to 65 wt % (preferably, 20 to 60 wt %; more preferably, 20 to 50 wt %; still more preferably, 25 to 40 wt %; most preferably, 25 to 35 wt %)(preferably, ≤20 wt %; more preferably, ≤25 wt %; preferably, ≤60 wt %; more preferably, ≤50 wt %; still more preferably, ≤40 wt %; most preferably, ≤35 wt %) of structural units of formula I;

(I)

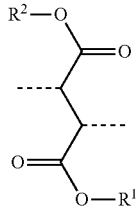

wherein each $R^1$ and $R^2$ is independently selected from a hydrogen and a $C_{1-3}$ alkyl group (preferably, a hydrogen and a $C_{2-3}$ alkyl group; more preferably, a hydrogen and a $C_3$ alkyl group)(preferably, wherein at least one of $R^1$ and $R^2$ is a $C_3$ alkyl group in at least 1 mol % of the structural units of formula I in the dispersant polymer); (b) 10 to 80 wt % (preferably, 15 to 60 wt %; more preferably, 20 to 55 wt %; most preferably, 30 to 50 wt %)(preferably, ≥20 wt %; more preferably, ≥25 wt %; still more preferably, ≥30 wt %; most preferably, ≥35 wt %; preferably, ≤60 wt %; more preferably, ≤55 wt %; most preferably, ≤50 wt %) of structural units of formula II (II)

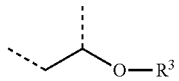

wherein each $R^3$ is independently selected from a hydrogen and a —C(O)$CH_3$ group; and (c) 10 to 65 wt % (preferably, 10 to 60 wt %; more preferably, 15 to 50 wt %; still more preferably, 20 to 40 wt %; most preferably, 25 to 35 wt %)(preferably, ≥10 wt %; more preferably, ≥15 wt %; preferably, ≤60 wt %; more preferably, ≤50 wt %; still more preferably, ≤40 wt %; most preferably, ≤35 wt %) of structural units of formula III (III)

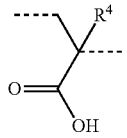

wherein each $R^4$ is independently selected from a hydrogen and a —$CH_3$ group; wherein at least one of $R^1$ and $R^2$ is a $C_{1-3}$ alkyl group in at least 1 mol % of the structural units of formula I in the dispersant polymer; wherein the dispersant polymer has a lactone end group and wherein the dispersant polymer has a weight average molecular weight of 1,500 to 6,000 Daltons (preferably, 1,500 to <5,000 Daltons; more preferably, 1,750 to 4,500 Daltons; most preferably, 2,250 to 4,250 Daltons).

Preferably, the automatic dishwashing composition of the present invention, comprises: a builder. Preferably, the builder used in the automatic dishwashing composition of the present invention, comprises at least one of a carbonate, a citrate and a silicate. Most preferably, the builder used in the automatic dishwashing composition of the present invention, comprises at least one of sodium carbonate, sodium bicarbonate and sodium citrate.

Preferably, the automatic dishwashing composition of the present invention, comprises: 1 to 97 wt % of a builder.

Preferably, the automatic dishwashing composition of the present invention, comprises: ≥1 wt % (preferably, ≥10 wt %; more preferably, ≥25 wt %; most preferably, ≥50 wt %) of the builder, based on the dry weight of the automatic dishwashing composition. Preferably, the automatic dishwashing composition of the present invention, comprises: ≤95 wt % (preferably, ≤90 wt %; more preferably, ≤85 wt %; most preferably, ≤80 wt %) of the builder, based on the dry weight of the automatic dishwashing composition. Weight percentages of carbonates, citrates and silicates are based on the actual weights of the salts, including metal ions.

The term "carbonate(s)" as used herein and in the appended claims refers to alkali metal or ammonium salts of carbonate, bicarbonate, percarbonate, and/or sesquicarbonate. Preferably, the carbonate used in the automatic dishwashing composition (if any) is selected from the group consisting of carbonate salts of sodium, potassium and lithium (more preferably, salts of sodium or potassium; most preferably, salts of sodium). Percarbonate used in the automatic dishwashing composition (if any) is selected from salts of sodium, potassium, lithium and ammonium (more preferably, salts of sodium or potassium; most preferably, salts of sodium). Most preferably, the carbonate used in the automatic dishwashing composition (if any) includes at least one of sodium carbonate, sodium bicarbonate and sodium percarbonate. Preferably, when the builder used in the automatic dishwashing composition of the present invention includes carbonate, the automatic dishwashing composition preferably, comprises 0 to 97 wt % (preferably, 5 to 75 wt %; more preferably, 10 to 60 wt %; most preferably 20 to 50 wt %) of carbonate.

The term "citrate(s)" as used herein and in the appended claims refers to alkali metal citrates. Preferably, the citrate used in the automatic dishwashing composition (if any) is selected from the group consisting of citrate salts of sodium, potassium and lithium (more preferably, salts of sodium or potassium; most preferably, salts of sodium). More preferably, the citrate used in the automatic dishwashing composition (if any) is sodium citrate. Preferably, when the builder used in the automatic dishwashing composition of the present invention includes citrate, the automatic dishwashing composition preferably, comprises 0 to 97 wt % (preferably, 5 to 75 wt %; more preferably, 10 to 60 wt %; most preferably 20 to 40 wt %) of the citrate.

The term "silicate(s)" as used herein and in the appended claims refers to alkali metal silicates. Preferably, the silicate used in the automatic dishwashing composition (if any) is selected from the group consisting of silicate salts of sodium, potassium and lithium (more preferably, salts of sodium or potassium; most preferably, salts of sodium). More preferably, the silicate used in the automatic dishwashing composition (if any) is sodium disilicate. Preferably, the builder used in the automatic dishwashing composition of the present invention includes a silicate. Preferably, when the builder used in the automatic dishwashing composition of the present invention includes a silicate, the automatic dishwashing composition preferably, comprises 0 to 97 wt % (preferably, 0.1 to 10 wt %; more preferably, 0.5 to 7.5 wt %; most preferably 0.75 to 3 wt %) of the silicate(s).

Preferably, the automatic dishwashing composition of the present invention comprises 0.1 to 15 wt % (more preferably, 0.5 to 10 wt %; still more preferably, 0.75 to 7.5 wt %; most preferably, 1 to 5 wt %) of a phosphonate. More preferably, the automatic dishwashing composition of the present invention comprises 0.1 to 15 wt % (more preferably, 0.5 to 10 wt %; still more preferably, 0.75 to 7.5 wt %; most preferably, 1 to 5 wt %) of a phosphonate; wherein the phosphonate is a low molecular weight having a weight average molecular weight of ≤1,000 Daltons. Still more preferably, the automatic dishwashing composition of the present invention comprises 0.1 to 15 wt % (more preferably, 0.5 to 10 wt %; still more preferably, 0.75 to 7.5 wt %; most preferably, 1 to 5 wt %) of a phosphonate; wherein the phosphonate comprises at least one of 1-hydroxyethylidene-1,1-diphosphonic acid (HEDP) and a salt of 1-hydroxyethylidene-1,1-diphosphonic acid. Most preferably, the automatic dishwashing composition of the present invention comprises 0.1 to 15 wt % (more preferably, 0.5 to 10 wt %; still more preferably, 0.75 to 7.5 wt %; most preferably, 1 to 5 wt %) of a phosphonate; wherein the phosphonate is selected from the group consisting of 1-hydroxyethylidene-1,1-diphosphonic acid (HEDP) and salts thereof.

Preferably, the automatic dishwashing composition of the present invention, comprises: 0.2 to 15 wt % (preferably, 0.5 to 10 wt %; more preferably, 1.5 to 7.5 wt %), based on the dry weight of the automatic dishwashing composition, of a nonionic surfactant. More preferably, the automatic dishwashing composition of the present invention, comprises: 0.2 to 15 wt % (preferably, 0.5 to 10 wt %; more preferably, 1.5 to 7.5 wt %), based on the dry weight of the automatic dishwashing composition, of the nonionic surfactant, wherein the surfactant comprises a fatty alcohol alkoxylate. Most preferably, the automatic dishwashing composition of the present invention, comprises: 0.2 to 15 wt % (preferably, 0.5 to 10 wt %; more preferably, 1.5 to 7.5 wt %), based on the dry weight of the automatic dishwashing composition, of the nonionic surfactant, wherein the surfactant is a fatty alcohol alkoxylate.

Preferably, the nonionic surfactant used in the automatic dishwashing composition of the present invention has a formula selected from $$RO\text{-}(M)_x\text{-}(N)_y\text{—}OH, \text{ and}$$

$$RO\text{-}(M)_x\text{-}(N)_y\text{—}(P)_z\text{—}OH$$

wherein M represents structural units of ethylene oxide, N represents structural units of $C_{3\text{-}18}$ 1,2-epoxyalkane, P represents structural units of $C_{6\text{-}18}$ alkyl glycidyl ether, x is 5 to 40, y is 0 to 20, z is 0 to 3 and R represents a $C_{6\text{-}22}$ linear or branched alkyl group.

Preferably, the nonionic surfactant used in the automatic dishwashing composition of the present invention has a formula selected from $$RO\text{—}(M)_x\text{—}(N)_y\text{—}OH, \text{ and}$$

$$RO\text{-}(M)_x\text{-}(N)_y\text{—}O\text{—}R'$$

wherein M and N are structural units derived from alkylene oxides (of which one is ethylene oxide); x is 5 to 40; y is 0 to 20; R represents a $C_{6\text{-}22}$ linear or branched alkyl group; and R' represents a group derived from the reaction of an alcohol precursor with a $C_{6\text{-}22}$ linear or branched alkyl halide, epoxyalkane or glycidyl ether.

Preferably, the nonionic surfactant used in the automatic dishwashing composition of the present invention has a formula $$RO\text{-}(M)_x\text{-}OH$$

wherein M represents structural units of ethylene oxide and x is at least three (preferably, at least five; preferably, no more than ten; more preferably, no more than eight). Preferably, wherein R and R' each have at least eight (more preferably, at least ten) carbon atoms.

Preferably, the automatic dishwashing composition of the present invention, includes a dispersant polymer. More preferably, the automatic dishwashing composition of the present invention, includes: 0.5 to 15 wt %, based on the dry weight of the automatic dishwashing composition, of a dispersant polymer. Still more preferably, the automatic dishwashing composition of the present invention, includes 0.5 to 10 wt %, based on the dry weight of the automatic dishwashing composition, of a dispersant polymer. Yet more preferably, the automatic dishwashing composition of the present invention, includes 1 to 8 wt %, based on the dry weight of the automatic dishwashing composition, of a dispersant polymer. Most preferably, the automatic dishwashing composition of the present invention, includes 2 to 6 wt %, based on the dry weight of the automatic dishwashing composition, of a dispersant polymer.

Preferably, the dispersant polymer used in the automatic dishwashing composition of the present invention comprises 10 to 65 wt % (preferably, 20 to 60 wt %; more preferably, 20 to 50 wt %; still more preferably, 25 to 40 wt %; most preferably, 25 to 35 wt %)(preferably, ≥20 wt %; more preferably, ≥25 wt %; preferably, ≤60 wt %; more preferably, ≤50 wt %; still more preferably, ≤40 wt %; most preferably, ≤35 wt %) of structural units of formula I (I)

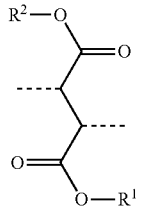

wherein each $R^1$ and $R^2$ is independently selected from a hydrogen and a $C_{1-3}$ alkyl group (preferably, a hydrogen and a $C_{2-3}$ alkyl group; more preferably, a hydrogen and a $C_3$ alkyl group). More preferably, the dispersant polymer used in the automatic dishwashing composition of the present invention comprises 10 to 65 wt % (preferably, 20 to 60 wt %; more preferably, 20 to 50 wt %; still more preferably, 25 to 40 wt %; most preferably, 25 to 35 wt %)(preferably, ≥20 wt %; more preferably, ≥25 wt %; preferably, ≤60 wt %; more preferably, ≤50 wt %; still more preferably, ≤40 wt %; most preferably, ≤35 wt %) of structural units of formula I; wherein at least one of $R^1$ and $R^2$ is a $C_{1-3}$ alkyl group (preferably, a $C_{2-3}$ alkyl group; more preferably, a $C_3$ alkyl group) in at least 1 mol % (preferably, 1 to 20 mol %; more preferably, 1 to 15 mol %; still more preferably, 2.5 to 12 mol %; most preferably, 5 to 10 mol %) of the structural units of formula I in the dispersant polymer. Most preferably, the dispersant polymer used in the automatic dishwashing composition of the present invention comprises 10 to 65 wt % (preferably, 20 to 60 wt %; more preferably, 20 to 50 wt %; still more preferably, 25 to 40 wt %; most preferably, 25 to 35 wt %)(preferably, ≥20 wt %; more preferably, ≥25 wt %; preferably, ≤60 wt %; more preferably, ≤50 wt %; still more preferably, ≤40 wt %; most preferably, ≤35 wt %) of structural units of formula I; wherein at least one of $R^1$ and $R^2$ is a $C_3$ alkyl group in at least 1 mol % (preferably, 1 to 20 mol %; more preferably, 1 to 15 mol %; still more preferably, 2.5 to 12 mol %; most preferably, 5 to 10 mol %) of the structural units of formula I in the dispersant polymer.

Preferably, the dispersant polymer used in the automatic dishwashing composition of the present invention comprises 10 to 80 wt % (preferably, 15 to 60 wt %; more preferably, 20 to 55 wt %; most preferably, 30 to 50 wt %)(preferably, ≥20 wt %; more preferably, ≥25 wt %; still more preferably, ≥30 wt %; most preferably, ≥35 wt %; preferably, ≤60 wt %; more preferably, ≤55 wt %; most preferably, ≤50 wt %) of structural units of formula II (II)

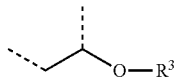

wherein each $R^3$ is independently selected from a hydrogen and a —C(O)$CH_3$ group. More preferably, the dispersant polymer used in the automatic dishwashing composition of the present invention comprises 10 to 80 wt % (preferably, 15 to 60 wt %; more preferably, 20 to 55 wt %; most preferably, 30 to 50 wt %)(preferably, ≥20 wt %; more preferably, ≥25 wt %; still more preferably, ≥30 wt %; most preferably, ≥35 wt %; preferably, ≤60 wt %; more preferably, ≥55 wt %; most preferably, ≤50 wt %) of structural units of formula II; wherein $R^3$ is a hydrogen in 0 to 50 mol % of the structural units of formula II in the dispersant polymer.

Preferably, the dispersant polymer used in the automatic dishwashing composition of the present invention comprises 10 to 65 wt % (preferably, 10 to 60 wt %; more preferably, 15 to 50 wt %; still more preferably, 20 to 40 wt %; most preferably, 25 to 35 wt %)(preferably, ≥10 wt %; more preferably, ≥15 wt %; preferably, ≤60 wt %; more preferably, ≤50 wt %; still more preferably, ≤40 wt %; most preferably, ≤35 wt %) of structural units of formula III (III)

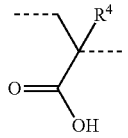

wherein each $R^4$ is independently selected from a hydrogen and a —$CH_3$ group. More preferably, the dispersant polymer used in the automatic dishwashing composition of the present invention comprises 10 to 65 wt % (preferably, 10 to 60 wt %; more preferably, 15 to 50 wt %; still more preferably, 20 to 40 wt %; most preferably, 25 to 35 wt %)(preferably, ≥10 wt %; more preferably, ≥15 wt %; preferably, ≤60 wt %; more preferably, ≤50 wt %; still more preferably, ≤40 wt %; most preferably, ≤35 wt %) of structural units of formula III; wherein each $R^4$ is a hydrogen in 75 to 100 mol % (preferably, 85 to 100 mol %; more preferably, 95 to 100 mol %; still more preferably, ≥99 mol %; most preferably, 100 mol %) of the structural units of formula III in the dispersant polymer.

Preferably, the dispersant polymer used in the automatic dishwashing composition of the present invention has a lactone end group. Preferably, the lactone end group is one produced by an internal esterification reaction between a carboxylic acid group on a structural unit of formula III and a terminal hydroxy group derived from a chain transfer agent. Most preferably, the lactone end group is a γ-lactone.

Preferably, the dispersant polymer used in the automatic dishwashing composition of the present invention has a formula IV

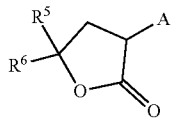

(IV)

wherein A is a polymer chain comprising structural units of formula I, structural units of formula II and structural units of formula III; wherein $R^5$ and $R^6$ are independently selected from a hydrogen and a $C_{1-5}$ alkyl group. Most preferably, the dispersant polymer used in the automatic dishwashing composition of the present invention has a formula IV, wherein A is a polymer chain comprising the structural units of units of formula I, structural units of formula II and structural units of formula III; wherein $R^5$ is methyl; and wherein $R^6$ is methyl.

Preferably, the dispersant polymer used in the automatic dishwashing composition of the present invention has a weight average molecular weight of 1,500 to 6,000 Daltons. More preferably, the dispersant polymer used in the automatic dishwashing composition of the present invention has a weight average molecular weight of 1,500 to <5,000 Daltons. Still more preferably, the dispersant polymer used in the automatic dishwashing composition of the present invention has a weight average molecular weight of 1,750 to 4,500 Daltons. Most preferably, the dispersant polymer used in the automatic dishwashing composition of the present invention has a weight average molecular weight of 2,250 to 4,250 Daltons.

Preferably, the dispersant polymer used in the automatic dishwashing composition of the present invention comprises ≤8 wt % (preferably, ≤5 wt %; more preferably, ≤3 wt %; most preferably, ≤1 wt %) of structural units of esters of (meth)acrylic acid.

Preferably, the dispersant polymer used in the automatic dishwashing composition of the present invention comprises ≤0.3 wt % (more preferably, ≤0.1 wt %; still more preferably, 0.05 wt %; yet still more preferably, 0.03 wt %; most preferably, ≤0.01 wt %) of structural units of multi-ethylenically unsaturated crosslinking monomer.

Preferably, the dispersant polymer used in the automatic dishwashing composition of the present invention comprises ≤1 wt % (preferably, ≤0.5 wt %; more preferably, ≤0.001 wt %; still more preferably, ≤0.0001 wt %; most preferably, < the detectable limit) of structural units of sulfonated monomer. More preferably, the dispersant polymer used in the automatic dishwashing composition of the present invention comprises ≤1 wt % (preferably, ≤0.5 wt %; more preferably, ≤0.001 wt %; still more preferably, ≤0.0001 wt %; most preferably, ≤ the detectable limit) of structural units of sulfonated monomer selected from the group consisting of 2-acrylamido-2-methylpropane sulfonic acid (AMPS), 2-methacrylamido-2-methylpropane sulfonic acid, 4-styrenesulfonic acid, vinylsulfonic acid, 3-allyloxy sulfonic acid, 2-hydroxy-1-propane sulfonic acid (HAPS), 2-sulfoethyl (meth)acrylic acid, 2-sulfopropyl(meth)acrylic acid, 3-sulfopropyl(meth)acrylic acid, 4-sulfobutyl(meth)acrylic acid and salts thereof. Most preferably, the dispersant polymer used in the automatic dishwashing composition of the present invention comprises ≤1 wt % (preferably, ≤0.5 wt %; more preferably, ≤0.001 wt %; still more preferably, ≤0.0001 wt %; most preferably, ≤ the detectable limit) of structural units of 2-acrylamido-2-methylpropane sulfonic acid (AMPS) monomer.

Preferably, the dispersant polymer used in the automatic dishwashing composition of the present invention is produced by solution polymerization. Preferably, the dispersant polymer is a random copolymer. Preferably, the solvent used in the synthesis of the dispersant polymer is selected from aqueous 2-propanol, aqueous ethanol, anhydrous 2-propanol, anhydrous ethanol and mixtures thereof.

Preferably, the dispersant polymer used in the automatic dishwashing composition of the present invention is provided in the form of a water-soluble solution polymer, a slurry, a dried powder, granules or another solid form.

The automatic dishwashing composition of the present invention, optionally further comprises: an additive. Preferably, the automatic dishwashing composition of the present invention, further comprises: an additive selected from the group consisting of an alkaline source; a bleaching agent (e.g., sodium percarbonate, sodium perborate); a bleach activator (e.g., tetraacetylethylenediamine (TAED)); a bleach catalyst (e.g., manganese(II) acetate, cobalt(II) chloride, bis(TACN)magnesium trioxide diacetate); an enzyme (e.g., protease, amylase, lipase, or cellulase); a foam suppressant; a coloring agent; a fragrance; a silicate; an additional builder; an antibacterial agent; a filler; a deposit control polymer and mixtures thereof. More preferably, the automatic dishwashing composition of the present invention, further comprises an additive, wherein the additive is selected from the group consisting of a bleaching agent, a bleach activator, an enzyme, a filler and mixtures thereof. Still more preferably, the automatic dishwashing composition of the present invention, further comprises an additive, wherein the additive includes a bleaching agent (e.g., sodium percarbonate, sodium perborate); a bleach activator (e.g., tetraacetylethylenediamine (TAED)) and an enzyme (e.g., protease, amylase, lipase, or cellulase). Most preferably, the automatic dishwashing composition of the present invention, further comprises an additive, wherein the additive includes a bleaching agent, wherein the bleaching agent includes sodium percarbonate; a bleach activator, wherein the bleach activator includes tetraacetylethylenediamine (TAED); and an enzyme, wherein the enzyme includes a protease and an amylase.

Fillers included in tablets or powders are inert, water-soluble substances, typically sodium or potassium salts (e.g., sodium sulfate, potassium sulfate, sodium chloride, potassium cloride). In tablets and powders, fillers are typically present in amounts ranging from 0 wt % to 75 wt %. Fillers included in gel formulations typically include those mentioned for use in tablets and powders and also water. Fragrances, dyes, foam suppressants, enzymes and antibacterial agents usually total no more than 10 wt %, alternatively no more than 5 wt %, of the automatic dishwashing composition.

The automatic dishwashing composition of the present invention, optionally further comprises: an alkaline source. Suitable alkaline sources include, without limitation, alkali metal carbonates and alkali metal hydroxides, such as sodium or potassium carbonate, bicarbonate, sesquicarbonate, sodium, lithium, or potassium hydroxide, or mixtures of the foregoing. Sodium hydroxide is preferred. The amount of alkaline source in the automatic dishwashing composition of the present invention (if any) is at least 1 wt % (preferably, at least 20 wt %) and up to 80 wt % (preferably, up to 60 wt %), based on the dry weight of the automatic dishwashing composition.

The automatic dishwashing composition of the present invention, optionally further comprises: a bleaching agent (e.g., sodium percarbonate). The amount of the bleaching agent in the automatic dishwashing composition of the present invention (if any) is preferably at a concentration of 1 to 25 wt % (more preferably, 5 to 20 wt %), based on the dry weight of the automatic dishwashing composition.

The automatic dishwashing composition of the present invention, optionally further comprises: a bleach activator (e.g., tetraacetylethylenediamine (TAED)). The amount of the bleach activator in the automatic dishwashing composition of the present invention (if any) is preferably at a concentration of 1 to 10 wt % (more preferably, 2.5 to 7.5 wt %), based on the dry weight of the automatic dishwashing composition.

Preferably, the automatic dishwashing composition of the present invention comprises ≤1 wt % (preferably, ≤0.5 wt %; more preferably, ≤0.2 wt %; still more preferably, ≤0.1 wt %; yet still more preferably, ≤0.01 wt %; most preferably, ≤the detectable limit), based on the dry weight of the automatic dishwashing composition, of phosphate (measured as elemental phosphorus). Preferably, the automatic dishwashing composition of the present invention is phosphate free.

Preferably, the automatic dishwashing composition of the present invention comprises ≤1 wt % (preferably, ≤0.5 wt %; more preferably, ≤0.2 wt %; still more preferably, ≤0.1 wt %; yet still more preferably, ≤0.01 wt %; most preferably, ≤the detectable limit), based on the dry weight of the automatic dishwashing composition, of builders selected from the group consisting of nitrilotriacetic acid; ethylenediaminetetraacetic acid; diethylenetriaminepentaacetic acid; glycine-N,N-diacetic acid; methyl glycine-N,N-diacetic acid; 2-hydroxyethyliminodiacetic acid; glutamic acid-N,N-diacetic acid; 3-hydroxy-2,2'-iminodissuccinate; S,S-ethylenediaminedisuccinate aspartic acid-diacetic acid; N,N'-ethylene diamine disuccinic acid; iminodisuccinic acid; aspartic acid; aspartic acid-N,N-diacetic acid; beta-alaninediacetic acid; polyaspartic acid; salts thereof and mixtures thereof. Most preferably, the automatic dishwashing composition of the present invention contains 0 wt % of builders selected from the group consisting of nitrilotriacetic acid; ethylenediaminetetraacetic acid; diethylenetriaminepentaacetic acid; glycine-N,N-diacetic acid; methyl glycine-N,N-diacetic acid; 2-hydroxyethyliminodiacetic acid; glutamic acid-N,N-diacetic acid; 3-hydroxy-2,2'-iminodissuccinate; S,S-ethylenediaminedisuccinate aspartic acid-diacetic acid; N,N'-ethylene diamine disuccinic acid; iminodisuccinic acid; aspartic acid; aspartic acid-N,N-diacetic acid; beta-alaninediacetic acid; polyaspartic acid; salts thereof and mixtures thereof.

Preferably, the automatic dishwashing composition of the present invention has a pH (at 1 wt % in water) of at least 9 (preferably, ≥10; more preferably, ≥11.5). Preferably, the automatic dishwashing composition of the present invention has a pH (at 1 wt % in water) of no greater than 13.

Preferably, the automatic dishwashing composition of the present invention can be formulated in any typical form, e.g., as a tablet, powder, block, monodose, sachet, paste, liquid or gel. The automatic dishwashing compositions of the present invention are useful for cleaning ware, such as eating and cooking utensils, dishes, in an automatic dishwashing machine.

Preferably, the automatic dishwashing composition of the present invention are suitable for use under typical operating conditions. For example, when used in an automatic dishwashing machine, typical water temperatures during the washing process preferably are from 20° C. to 85° C., preferably 30° C. to 70° C. Typical concentrations for the automatic dishwashing composition as a percentage of total liquid in the dishwasher preferably are from 0.1 to 1 wt %, preferably from 0.2 to 0.7 wt %. With selection of an appropriate product form and addition time, the automatic dishwashing compositions of the present invention may be present in the prewash, main wash, penultimate rinse, final rinse, or any combination of these cycles.

Preferably, the method of cleaning an article in an automatic dishwashing machine of the present invention, comprises: providing at least one article (e.g., cookware, bakeware, tableware, dishware, flatware and/or glassware); providing an automatic dishwashing composition of the present invention; and applying the automatic dishwashing composition to the at least one article (preferably, in an automatic dishwasher).

Some embodiments of the present invention will now be described in detail in the following Examples.

The weight average molecular weight, Mw; number average molecular weight, MN; and polydispersity (PDI) values reported in the Examples were measured by gel permeation chromatography (GPC) on an Agilent 1100 series LC system equipped with an Agilent 1100 series refractive index. Samples were dissolved in HPCL grade THF/FA mixture (100:5 volume/volume ratio) at a concentration of approximately 9 mg/mL and filtered through at 0.45 μm syringe filter before injection through a 4.6×10 mm Shodex KF guard column, a 8.0×300 mm Shodex KF 803 column, a 8.0×300 mm Shodex KF 802 column and a 8.0×100 mm Shodex KF-D column. A flow rate of 1 mL/min and temperature of 40° C. were maintained. The columns were calibrated with narrow molecular weight PS standards (Easi-Cal PS-2, Polymer Laboratories, Inc.).

Comparative Example C1

Synthesis of Dispersant Polymer

A 4-neck, one liter round bottom flask, equipped with overhead stirrer, Claisen head, septa inlet, and thermometer was charged with 225.0 g of methyl ethyl ketone (MEK) and flushed with nitrogen. The solution was heated to 80° C. and 0.45 g t-butyl peroxypivalate (75 wt % in mineral spirits) was added. A premixed homogenous solution of 73.50 g of vinyl acetate, 82.41 g of maleic anhydride and 30.50 g acrylic acid was added, via a pump, over 2 hours, followed by a 4.5 g wash with MEK. Separately, a solution of 7.0 g t-butyl peroxypivalate (75 wt % in mineral spirits) diluted to 9.0 g with MEK was also added via a syringe pump over 2 hours. A solution of 4.1 g methyl 3-mercaptopropionate diluted to 9 g with MEK was also added via a syringe pump over 2 hours. The polymer produced in this manner was subject to solvent exchange with water using a Dean Stark trap. A portion of 368 g of water was added over one hour, while a total of 281 grams of IPA-water distillate was removed.

Example 1

Synthesis of Dispersant Polymer

To a glass reactor contained within a stainless steel jacket equipped with an overhead stirrer, a nitrogen bubbler, a pressure controller, a reflux condenser and a temperature controller was added a mixture of 2-propanol (825 g) and deionized water (275 g). Then maleic anhydride (1,940 g)

was added to the reactor. Then a second mixture of 2-propanol (4,561 g) and deionized water (1,518 g) was added to the reactor. The temperature controller set point was set at 70° C. The overhead stirrer was set at 250 rpm. After the maleic anhydride dissolved, the temperature controller set point was raised to 80° C. When the temperature of the reactor contents reached 75° C., the reactor was capped and the pressure controller was set to provide a pressure on the reactor contents of 30 psig. Then the addition to the reactor contents of a catalyst solution of tert-butyl peroxypivilate (444 g) in 2-propanol (1,036 g) was initiated with a flow rate of 6.98 g/min. Then 2 minutes after initiation of the catalyst solution charge, the addition to the reactor contents of a monomers glacial acrylic acid (1,940 g) and vinyl acetate (2,566 g) was initiated with flow rates of 10.78 g/min (over 180 minutes) and 21.38 g/min (over 120 minutes) respectively. Upon completion of the monomer feed, the transfer lines were rinsed into the reactor contents with 2-propanol (242 g). Upon completion of the catalyst feed, the transfer lines were rinsed into the reactor contents with 2-propanol (242 g). After completion of the catalyst solution addition, the reactor contents were held for 30 minutes, after which the temperature controller was shut down and the reactor contents were allowed to cool. When the temperature of the reactor contents dropped to 70° C., the reactor was depressurized to atmospheric pressure. When the temperature of the reactor contents dropped to 40° C., the reactor contents were filtered through a 100 mesh bag. The polymer product obtained was then measured at 48.9 wt % solids. A 1,000 g portion polymer product was then subjected to solvent exchange with water using a Dean Stark trap. A portion of 500 g of water was added over one hour, while a total of 709 g of IPA-water distillate was removed. A 50% NaOH solution was added to achieve a final pH of 6.02. The weight average molecular weight, Mw, of the polymer product was then measured with the results provided in TABLE 1.

TABLE 1

| | Monomer Feed composition (wt %) | | | |
|---|---|---|---|---|
| Example | Maleic anhydride | Vinyl Acetate | Acrylic Acid | Weight average molecular weight |
| Comp. C1 | 44.2 | 39.4 | 16.4 | 9,123 Daltons |
| 1 | 30 | 40 | 30 | 3,807 Daltons |

Comparative Example SC1-SC2 and Example S1

Stock Polymer Solutions

A stock polymer solution was prepared in Comparative Example SC1 by adding to 99 g of water in a beaker, 1 g of the polymer prepared according to Comparative Example C1. A stock polymer solution was prepared in Comparative Example SC2 by diluting to 1 wt % solids a polyacrylic acid dispersant solution (Acusol™ 445N dispersant solution available from The Dow Chemical Company). A stock polymer solution was prepared in Example S1 by adding to 99 g of water in a beaker, 1 g of the polymer prepared according to Example 1.

Hardness Tolerance

The hard water tolerance of the polymers prepared according to Comparative Example C1, Example 1 and the polyacrylic acid dispersant solution of Comparative Example SC2 were evaluated by adding magnetic stir bars to the beakers containing the stock solutions prepared according to Comparative Examples SC1-SC2 and Example S1 and placing the beakers on a magnetic stir plate. The pH of both stock solutions were adjusted to 10 by adding sodium hydroxide as necessary. Using an immersion colorimeter probe, the initial transmittance of each solution was measured and recorded. At time=0, 100 ppm of a hardness solution (0.1 g of a 2 Ca:1 Mg) was added to each stock solution. The stock solutions were left to stir for 1 minute. At time=1 minute, the transmittance of each solution was measured and recorded. Then an additional 100 ppm of hardness solution was added. One minute following the hardness solution addition, the transmittance was measured and recorded. This process was repeated until time=20 minutes or until the transmittance of a given solution fell below 40%. The results are provided in TABLE 2.

TABLE 2

| Time | Added $CaCO_3$ Hardness | % transmittance through polymer solution | | |
|---|---|---|---|---|
| (mm) | (ppm mass) | Comp. Ex. SC1 | Comp. Ex. SC2 | Ex. Si |
| 0 | 0 | 100.0 | 100.0 | 100.0 |
| 1 | 100 | 100.0 | 100.0 | 100.0 |
| 2 | 200 | 100.0 | 100.0 | 100.0 |
| 3 | 300 | 99.9 | 99.9 | 100.0 |
| 4 | 400 | 96.1 | 99.9 | 100.0 |
| 5 | 500 | 74.7 | 99.9 | 100.0 |
| 6 | 600 | 48.9 | 99.9 | 100.0 |
| 7 | 700 | 27.2 | 99.8 | 100.0 |
| 8 | 800 | — | 99.2 | 100.0 |
| 9 | 900 | — | 93.1 | 99.9 |
| 10 | 1,000 | — | 82.0 | 99.8 |
| 11 | 1,100 | — | 68.2 | 99.7 |
| 12 | 1,200 | — | 55.9 | 99.6 |
| 13 | 1,300 | — | 46.4 | 99.5 |
| 14 | 1,400 | — | 39.6 | 99.4 |
| 15 | 1,500 | — | — | 99.3 |
| 16 | 1,600 | — | — | 99.2 |
| 17 | 1,700 | — | — | 99.2 |
| 18 | 1,800 | — | — | 99.0 |
| 19 | 1,900 | — | — | 99.0 |
| 20 | 2,000 | — | — | 98.9 |

Procedure for Preparing Food Soil

The STIWA Food soil described in TABLE 3 was prepared by the following procedure.

a) Bringing the water to a boil.
b) Mixing in a paper cup the instant gravy, the benzoic acid and the starch; and then adding the mixture to the boiling water.
c) Adding the milk and margarine to the product of (b).
d) Letting the product of (c) cool down to approximately 40° C., and then adding mixture to a kitchen mixer (Polytron).
e) Combining in another paper cup, the egg yolk, the ketchup and the mustard and mixing with a spoon.
f) Adding the product of (e) to the mixture of (d) in the blender with continuous stirring.
g) Letting the product of (f) stir in the blender for 5 minutes.
h) The freezing the product food soil mixture from (g).
i) 50 g of the frozen slush is placed into the dishwasher at beginning of the main wash.

TABLE 3

| Ingredient | Weight, g |
|---|---|
| Water | 700 |
| Margarine | 100 |
| Gravy Powder | 25 |

TABLE 3-continued

| Ingredient | Weight, g |
|---|---|
| Potato Starch | 5 |
| Benzoic Acid | 1 |
| Egg Yolk | 57 |
| Mustard | 25 |
| Ketchup | 25 |
| Milk | 50 |

Comparative Examples DC1-DC2 and Example D1: Dishwashing compositions

Dishwashing compositions were prepared in each of Comparative Examples DC1-DC2 and Example D1 having the component formulations identified in TABLE 4. The protease used in each of the component formulations was Savinase® 12T protease available from Novozymes. The amylase used in each of the component formulations was Stainzyme® 12T amylase available from Novozymes.

| | Concentration on solids basis (wt %) | | |
|---|---|---|---|
| Ingredient | DC1 | DC2 | D1 |
| Sodium Citrate | 30 | 30 | 30 |
| Sodium Carbonate | 25 | 25 | 25 |
| Percarbonate | 15 | 15 | 15 |
| TAED | 4 | 4 | 4 |
| Sodium Disilicate[a] | 2 | 2 | 2 |
| Sodium Sulfate | 9 | 9 | 9 |
| Nonionic Surfactant[b] | 5 | 5 | 5 |
| HEDP[c] | 2 | 2 | 2 |
| Amylase | 1 | 1 | 1 |
| Protease | 2 | 2 | 2 |
| Dispersant Polymer[d] | 5 | — | — |
| Dispersant Polymer[e] | — | 5 | — |
| Example 1 | — | — | 5 |

[a]Britesil ® H20 hydrous sodium silicate available from PQ Corporation.
[b]Dowfax ™ 20B102 nonionic linear alcohol alkoxylate available from The Dow Chemical Company.
[c]Dequest ™ 2010 organophosphonate available from Italmatch Chemicals S.p.A.
[d]Acusol ™ 588 dispersant (polyacrylate copolymer) available from The Dow Chemical Company.
[e]Acusol ™ 445N dispersant (polyacrylic acid polymer) available from The Dow Chemical Company.

Dishwashing Test Conditions

Machine: Miele SS-ADW, Model G1222SC Labor. Wash at 65° C.-30 min, prewash. Water: 37° fH hardness, Ca: Mg =3:1. Food soil: 50 g of the composition noted in TABLE 3 was introduced to the wash liquor frozen in a cup. Each dishwashing composition from Comparative Examples DC1-$DC_3$ and Example D1 were tested, dosed at 20 g per wash.

Glass Tumbler Filming and Spotting Evaluation

After each of 10 wash cycles, 20 wash cycles and 30 wash cycles under the above dishwashing test conditions, the glass tumblers were dried in open air. After drying in open air filming and spotting ratings were determined by trained evaluators by observations of glass tumblers in a light box with controlled illumination from below. Glass tumblers were rated for filming and spotting according to ASTM method ranging from 1 (no film/spots) to 5 (heavily filmed/spotted). An average value of 1 to 5 for filming and spotting was determined as reported in TABLE 5.

TABLE 5

| | Filming cycles | | | Spotting cycles | | |
|---|---|---|---|---|---|---|
| Composition | 10 | 20 | 30 | 10 | 20 | 30 |
| Comp. Example DC1 | 1.5 | 2.0 | 2.5 | 4.0 | 5.0 | 5.0 |
| Comp. Example DC2 | 2.0 | 2.0 | 2.5[a] | — | — | — |
| Example D1 | 2.5 | 2.0 | 2.5 | 3.0 | 3.0 | 2.5 |

[a]Film observed to have a noticeable blue tint, indicative of a calcium phosphonate and/or a magnesium silicate film formation viewed negatively by consumers as more noticeable than other films Stainless Steel Filming and Spotting Evaluation After 30 wash cycles under the above dishwashing test conditions, the stainless steel plates were dried in open air. After drying in open air filming and spotting ratings were determined by trained evaluators by observations of the stainless steel plates in a light box with controlled illumination. Stainless steel plates were rated for filming and spotting according to ASTM method ranging from 1 (no film/spots) to 5 (heavily filmed/spotted). An average value of 1 to 5 for filming and spotting was determined as reported in TABLE 6.

TABLE 6

| Composition | Filming | Spotting |
|---|---|---|
| Comp. Example DC1 | 1 | 1 |
| Comp. Example DC2 | 4 | 1 |
| Example D1 | 2 | 1 |

We claim:

1. An automatic dishwashing composition, comprising:

a builder;

a phosphonate;

a nonionic surfactant; and a dispersant polymer, comprising:

(a) 10 to 65 wt % of structural units of formula I (I)

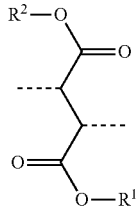

wherein each $R^1$ and $R^2$ is independently selected from a hydrogen and a $C_{1-3}$ alkyl group;

(b) 10 to 80 wt % of structural units of formula II (II)

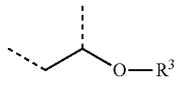

wherein each $R^3$ is independently selected from a hydrogen and a —C(O)$CH_3$ group; and (c) 10 to 65 wt % of structural units of formula III (III)

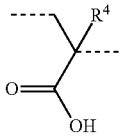

wherein each $R^4$ is independently selected from a hydrogen and a —$CH_3$ group; and wherein at least one of $R^1$ and $R^2$ is a $C_{1-3}$ alkyl group in at least 1 mol % of the structural units of formula I in the dispersant polymer; wherein the dispersant polymer has a lactone end group and wherein the dispersant polymer has a weight average molecular weight of 1,500 to 6,000 Daltons.

2. The automatic dishwashing composition of claim 1, wherein at least one of $R^1$ and $R^2$ is a $C_3$ alkyl group in 1 to 20 mol % of the structural units of formula I in the dispersant polymer.

3. The automatic dishwashing composition of claim 1, wherein $R^3$ is a hydrogen in 0 to 50 mol % of the structural units of formula II in the dispersant polymer.

4. The automatic dishwashing composition of claim 1, wherein the automatic dishwashing composition contains less than 0.1 wt %, based on the dry weight of the automatic dishwashing composition, of phosphate, measured as elemental phosphorus.

5. The automatic dishwashing composition of claim 4, wherein the automatic dishwashing composition contains 0 wt %, based on the dry weight of the automatic dishwashing composition, of builders selected from the group consisting of nitrilotriacetic acid; ethylenediaminetetraacetic acid; diethylenetriaminepentaacetic acid; glycine-N,N-diacetic acid; methyl glycine-N,N-diacetic acid; 2-hydroxyethyliminodiacetic acid; glutamic acid-N,N-diacetic acid; 3-hydroxy-2,2'-iminodissuccinate; S,S-ethylenediaminedisuccinate aspartic acid-diacetic acid; N,N'-ethylene diamine disuccinic acid; iminodisuccinic acid; aspartic acid; aspartic acid-N,N-diacetic acid; beta-alaninediacetic acid; polyaspartic acid; salts thereof and mixtures thereof.

6. The automatic dishwashing composition of claim 1, wherein the lactone end group is a γ-lactone.

7. The automatic dishwashing composition of claim 6, wherein the dispersant polymer is according to formula IV (IV)

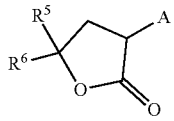

wherein A is a polymer chain comprising the structural units of formula I, the structural units of formula II, and the structural units of formula III; wherein $R^5$ is methyl; and wherein $R^6$ is methyl.

8. The automatic dishwashing composition of claim 7, further comprising an additive selected from the group consisting of a bleaching agent, a bleach activator, an enzyme, a filler, and mixtures thereof.

9. A method of cleaning an article in an automatic dishwashing machine, comprising:

providing at least one article;

providing an automatic dishwashing composition according to claim 1; and, applying the automatic dishwashing composition to the at least one article.

* * * * *